United States Patent [19]

Turner et al.

[11] 4,114,407

[45] Sep. 19, 1978

[54] SOFT FLOW JET DYEING MACHINE

[75] Inventors: James Keith Turner, Lincolnton; William Cleere Sturkey, Charlotte, both of N.C.

[73] Assignee: Gaston County Dyeing Machine Company, Mount Holly, N.C.

[21] Appl. No.: 792,460

[22] Filed: Apr. 29, 1977

Related U.S. Application Data

[63] Continuation of Ser. No. 690,574, May 27, 1976, abandoned.

[51] Int. Cl.[2] ..... D06B 3/24; D06B 3/28

[52] U.S. Cl. ..... 68/178

[58] Field of Search ..... 68/177, 178, 184, 62, 68/207

[56] References Cited

U.S. PATENT DOCUMENTS

| | | | |
|---|---|---|---|
| 3,780,544 | 12/1973 | Turner et al. | 68/177 |
| 3,921,420 | 11/1975 | Aurich et al. | 68/178 X |
| 3,949,575 | 4/1976 | Turner et al. | 68/178 X |
| 3,982,411 | 9/1976 | Kreitz | 68/177 |
| 4,023,385 | 5/1977 | Hurd | 68/178 X |

FOREIGN PATENT DOCUMENTS

| | | | |
|---|---|---|---|
| 23,703 | 7/1972 | Japan | 68/178 |

*Primary Examiner*—Philip R. Coe

*Attorney, Agent, or Firm*—Richards, Shefte & Pinckney

[57] ABSTRACT

An improved jet dyeing machine is provided in which the jet circulation is arranged for extremely low impingement of the treating liquor on the fabric so that fabric composed of low twist spun yarns are handled at particularly good advantage, while excellent operating results are obtained as well with the considerable range of other fabrics that have heretofore been successfully handled by jet processing. The treating liquor circulation arrangement additionally provides for diversion of a major portion of the treating liquor being circulated so that foam generation is minimized and circulation performance is improved.

5 Claims, 5 Drawing Figures

SOFT FLOW JET DYEING MACHINE

CROSS-REFERENCE TO RELATED APPLICATIONS

This is a continuation of copending application Ser. No. 690,574, filed May 27, 1976, and now abandoned in favor of this application.

BACKGROUND OF THE INVENTION

Jet dyeing apparatus, such as is representatively described in U.S. Pat. No. 3,780,544, has heretofore been employed extensively and quite successfully for wet processing textile piece goods in rope form. Recently, however, there has been a trend toward use of fabrics formed of relatively low twist spun fibers of either natural or synethetic materials or blends thereof, and jet processing of such fabrics have presented troublesome problems because of adverse effects on the fabric resulting from unduly high impingement action of the jetted treating liquor on the fabric. The present invention provides a modified circulation arrangement producing a soft flow jetting of the treating liquor that eliminates these problems and that allows very successful jet machine handling of light weight cottons, cotton-polyesters, acrylics and other spun fiber fabrics with which difficulty has been encountered with prior art jet dyeing machine arrangements.

SUMMARY OF THE INVENTION

The soft flow jet dyeing machine arrangement of the present invention is similar to prior art arrangements in that it employs a vessel for containing the treating liquor to be used for the wet processing and through which the textile material is circulated in endless strand or rope form to and from a plaited accumulation within the vessel, but differs significantly in providing a rotatable lifter roll disposed above the processing vessel for vertically elevating the textile material progressively from the plaited accumulation and the treating liquor within the vessel, together with an adjacently disposed and downwardly inclined textile material directing tube for receiving textile material from the lifter roll and having a downwardly extending end portion thereof concentrically enclosed within an intermediate cylindrical portion of a treating liquor tube extending downwardly for discharge within the processing vessel, the intermediate portion being free of internal restriction and extending downwardly beyond the end portion, while the remaining portion of the textile material directing tube is surrounded by a plenum chamber communicating with the treating liquor tube.

Means is additionally provided for continuously circulating treating liquor from the processing vessel to the abovenoted plenum chamber for delivery to the treating liquor tube and return therethrough to the processing vessel while effecting active treating liquor penetration of the textile material and directing return of the material being treated to the plaited accumulation in the processing vessel. As a result, the jetted treating liquor is caused to encompass the textile material rope delivered from the lifter roll and penetrates it quite effectively but very gently, so that the saturated textile material is caused to move through the downwardly extending treating liquor tube and return it to the processing vessel essentially by gravity, rather than any force exerted by jetting of the treating liquor and thereby eliminate any adverse jet induced impingement influence on the textile material being circulated.

In addition, the treating liquor tube is fitted with a diversion elbow ahead of the point of discharge thereof into the processing vessel, and this diversion elbow is arranged to receive a major portion of the circulating treating liquor from the treating liquor tube and the elbow is connected for separately directing the treating liquor received to the processing vessel below the treating liquor level therein and adjacent the point at which treating liquor is circulated from the processing vessel by the means provided therefor. This arrangement results in minimizing foam generation during the processing operation and also facilitates treating liquor circulation for the processing. These and other features of the soft flow jet dyeing system provided are described in further detail below in connection with the accompanying drawings.

DETAILED DESCRIPTION OF THE INVENTION

Figure 1:
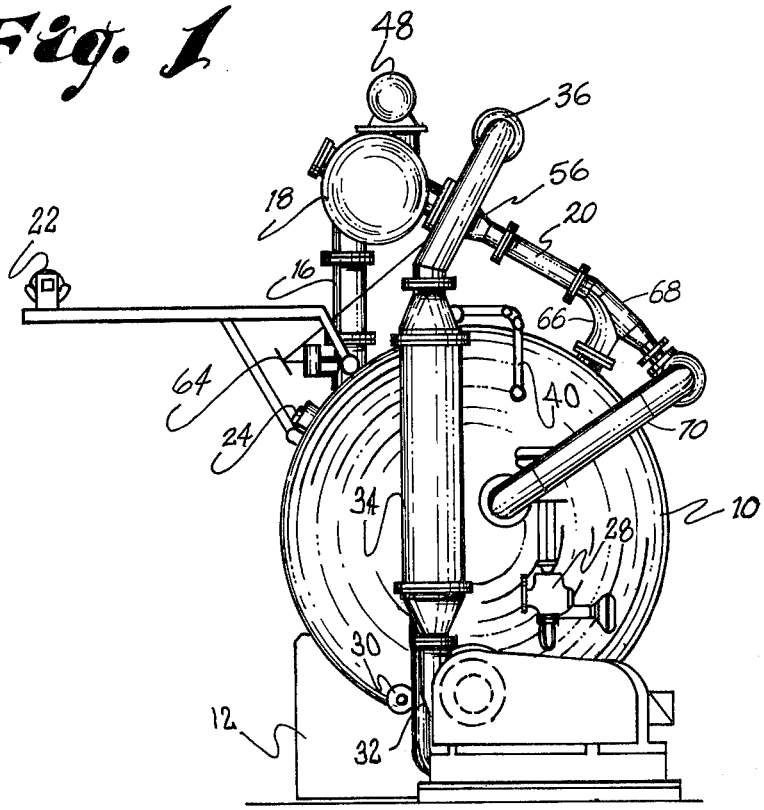
FIG. 1 is an end elevation of a representative jet dyeing machine embodying the present invention.
Figure 2:
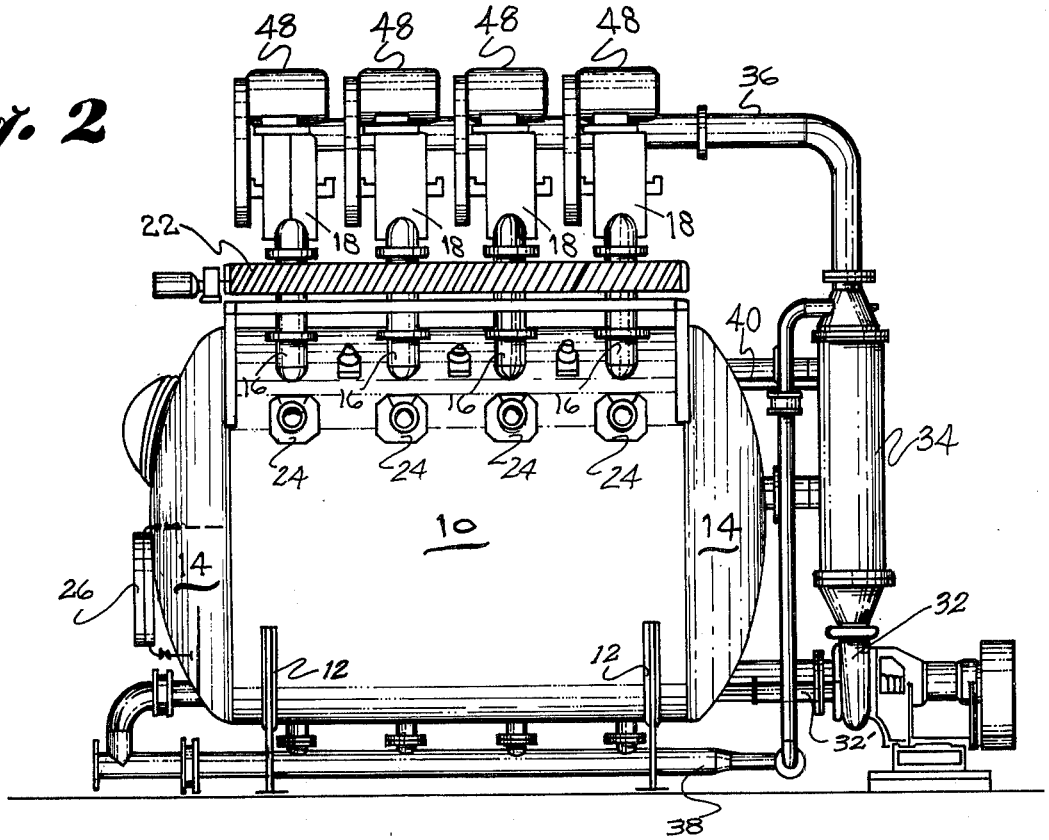
FIG. 2 is a left side elevation of the FIG. 1 machine.

The representative jet dyeing machine embodiment shown in FIGS. 1 and 2 comprises a processing vessel or kier 10 arranged with four jet processing positions. The vessel or kier 10 is of cylindrical form mounted horizontally on suitable standards 12 and fitted at each end with dished heads 14 of usual pressure-resisting form.

To provide for circulation of the textile material to be treated during processing operation a superstructure is mounted on the vessel 10 comprising a vertically disposed intake leg 16, a cylindrical housing 18 at the top of intake leg 16, and a downwardly inclinded discharge leg 20 extending from housing 18, the particular arrangement and respective functions of which superstructure elements will be described further presently.

A driven reel arrangement 22 is mounted by an extending bracket structure on the vessel 10 for use in unloading textile material after processing. Vessel 10 is fitted with access ports 24 at each processing position for such unloading and for loading as well. A sight glass indicator 26 is arranged at lefthand vessel head 14 as seen in FIG. 2 for showing liquid level within the vessel 10, and a three-way fitting 28 is provided at the righthand head 14 (see FIG. 1) to provide for a valve controlled hot and cold water mix suitable for addding water at a desired temperature whenever required during processing. A chemical add line connection 30 is also provided at the righthand vessel head 14 for introducing dyestuff formulations and the like as needed for processing.

Circulation of treating liquor is also provided for through a connection 32' at the righthand vessel head 14 to a motor-driven pump 32 the discharge from which is directed through a heat exchanger unit 34 by which treating liquor temperature is maintained and from which a manifold 36 is fed to supply the several processing positions as will appear further below. At the discharge end of heat exchanger unit 34 a by-pass line is connected to feed a manifold 38 by which a portion of the circulating treating liquor is returned to the bottom of vessel 10 to facilitate movement of the plaited accumulation of textile material through the processing vessel 10. Also, a second bypass line 40 is connectd from the discharge end of heat exchanger 34 to supply a spray manifold running within vessel 10 to wet the interior thereof fully during processing operation and maintain the interior surfaces clear of objectionable deposits that are otherwise apt to form thereon. The bottom by-pass line 38 is also arranged by suitable valving to serve as a drain line for vessel 10 whenever needed for this purpose.

Figure 3:
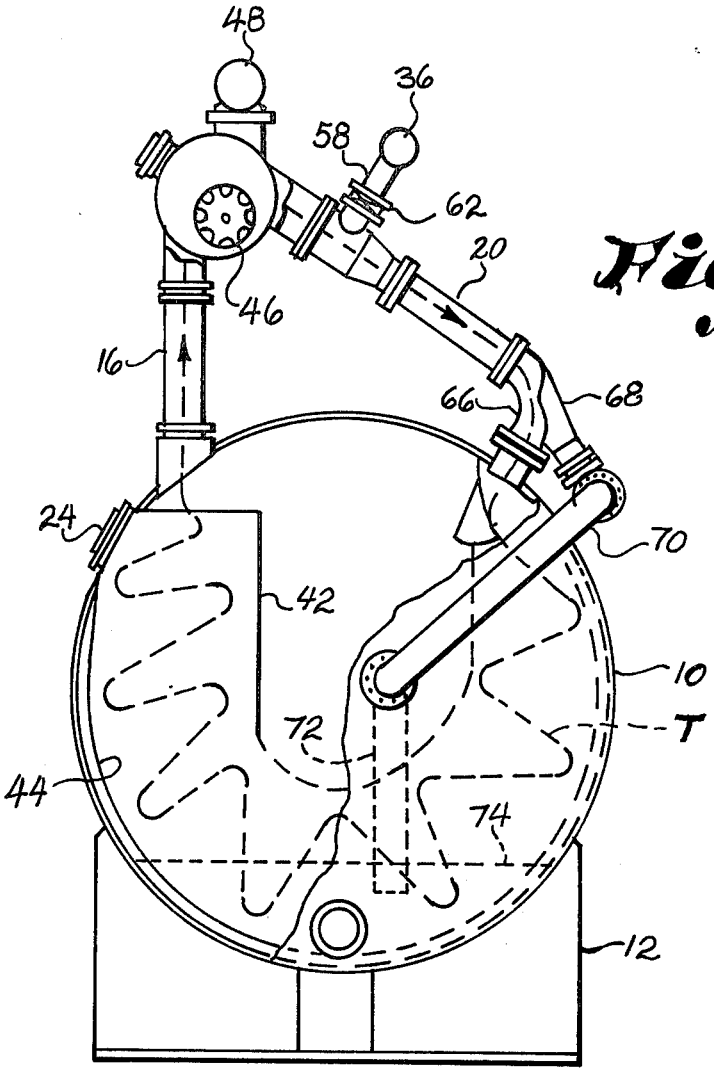
FIG. 3 is a schematic diagram illustrating the internal structural and operating arrangemet of the FIG. 1 machine.

FIG. 3 of the drawings illustrates further the internal structural and operating arrangement in more or less schematic fashion. In this connection it is to be noted first that inner and outer spaced shells 42 and 44 are installed and partitioned in vessel 10 at each process station in J-box fashion to receive and transiently contain the plaited accumulation of textile material in an orderly manner during processing operation. The general path of the circulating textile material is indicated in dotted lines in FIG. 3 at T as being elevated progressively from the plaited accumulation and the treating liquor in vessel 10 through the vertical intake leg 16 of the vessel superstructure by a lifter roll 46 housed and supported for rotation in superstructure housing portion 18. The lifter roll 46 is rotatably driven by a motor 48 mounted about housing 18 and suitably connected for this purpose as seen in FIG. 2. The lifter roll 46 is effectively arranged with spaced U-shaped spokes, as indicated in FIG. 3, to provide suitable traction for elevating the textile material being processed and delivering it to the adjacent downwardly inclined superstructure discharge leg 20. Alternatively, a lifter roll of the sort disclosed and claimed in copending application Ser. No. 651,129, filed Jan. 21, 1976, may be used if desired.

Figure 5:
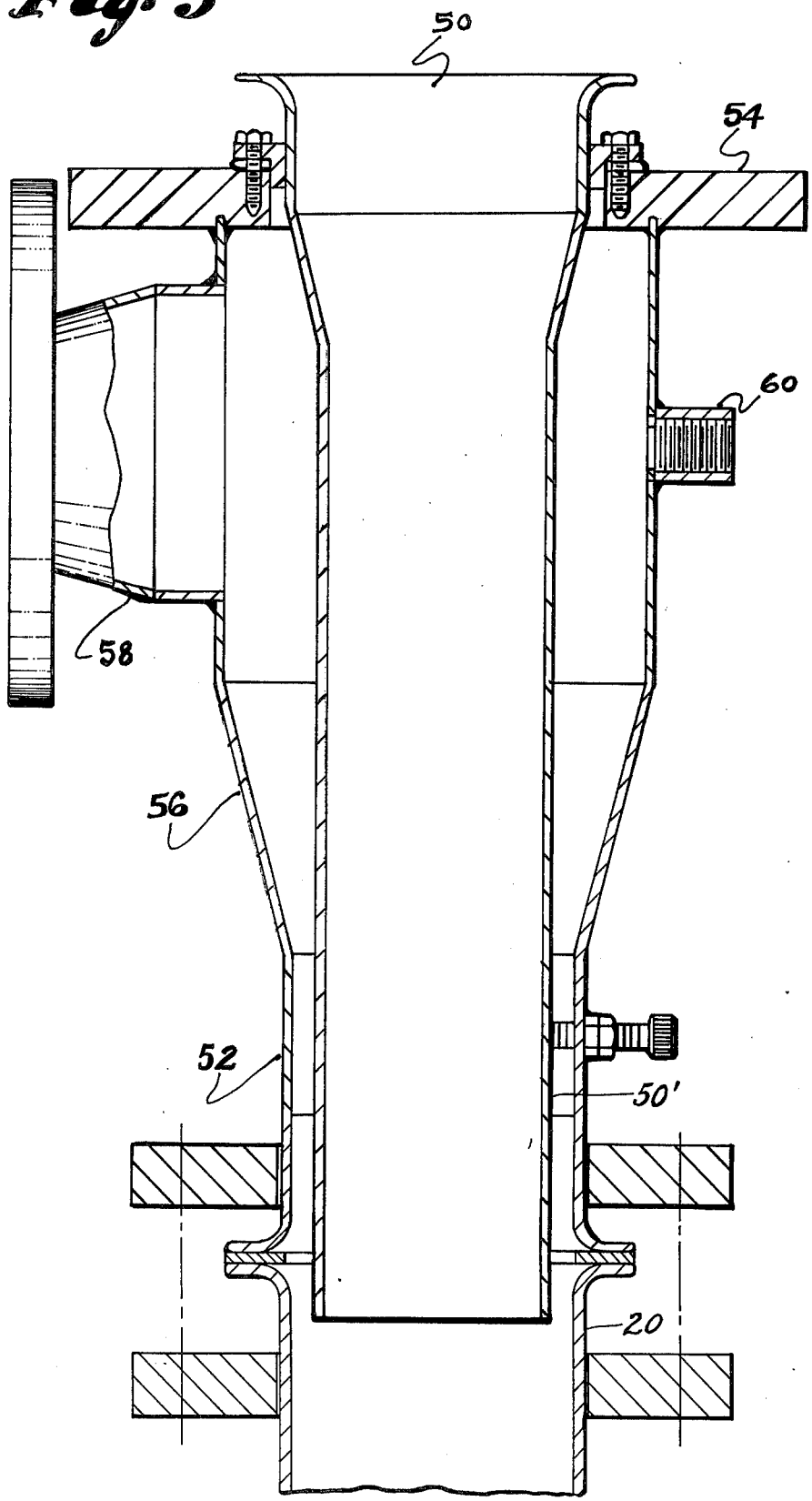
FIG. 5 is a sectional detail of the soft flow jetting arrangement employed according to the present invention.

FIG. 5 shows the jetting arrangement that is provided adjacently in the discharge leg of the vessel superstructure to receive the circulating textile material from lifter roll 46 at each processing station. This jetting arrangement includes an inner textile material directing tube 50 that is aligned with the downward inclination of discharge leg 20 and hving a downwardly extending end portion 50' thereof concentrically enclosed within an intermediate cylindrical portion of a treating liquor tube 52 that extends downwardly compositely and free from internal restriction through the remaining length of discharge leg 20 as indicated in FIG. 5 for discharge into the vessel 10. The intermediate portion is free of internal restriction and extends downwardly beyond the end portion 50'. The concentric disposition of the textile material directing tube 50 is maintained by positioning screws spaced 120° apart and extending from the adjacent wall of the treating liquor directing tube 52 for this purpose. The other end of the textile material directing tube 50 is mounted in a flange 54 so as to be aligned for receiving textile material from the lifter roll 46 and the remaining length of this directing tube 52 between flange 54 and the concentric portion of treating liquor tube 52 is surrounded by a plenum chamber 56 that communicates with the intermediate tube portion and is fed with treating liquor at a supply connection 58 from the treating liquor manifold 36 and at which a suitable fitting 60 is provided for installing a pressure gauge (not shown). The supply connection 58 at each processing station is equipped with a throttle valve 62 that is conveniently controlled by a handwheel 64 arranged to extend within reach of a machine operator (see FIG. 1).

The result of the foregoing arrangement is to supply the treating liquor from plenum chamber 56 so that an annular discharge is directed into the treating liquor tube 52 that encompasses and thoroughly penetrates the circulating textile material but does so with exceptional gentleness, as previously mentioned. Continuing circulation of the textile material is accordingly caused to proceed through the discharge leg 20 essentially by gravity, as also previously mentioned, but encompassed and facilitated by the treating liquor, and to be returned therefrom to the plaited accumulation in vessel 10 as is indicated in FIG. 3. To facilitate orderly piling of the returning textile material as it forms the plaited accumulation in vessel 10, an adjustable deflector plate of the form disclosed and claimed in copending application Ser. No. 688,189 filed May 20, 1976, is preferably installed in the wall of inner J-box shell 42 for this purpose.

Figure 4:
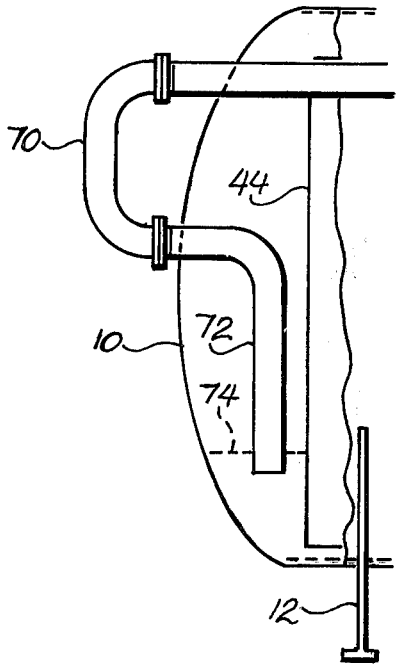
FIG. 4 is a fragmentary right side detail corresponding to FIG. 3.

The discharge leg 20 terminates in an elbow 66 for directing the returning discharge of the circulating textile material into vessel 10 and at this discharge elbow 66 a diversion elbow 68 is installed with a separating partition screen (not shown) that diverts a major portion of the treating liquor from the returning textile material and directs it separately through a connection 70 running outside the vessel 10 to a continuing connection 72 that returns within righthand vessel head 14 and extends downwardly through screening 74 therein above the vessel outlet 32' to circulating pump 32 (see FIGS. 3 and 4). The downward extent of this continuing extension 72 is such as to terminate below the treating liquor level normally maintained in vessel 10 so as to discharge the diverted treating liquor below this level and thereby minimize foam formation resulting from the returning treating liquor as well as improving the conditions under which the circulating pump 32 draws from vessel 10 to maintain the treating liquor circulation required during processing.

The present invention has been described in detail above for purposes of illustration only and is not intended to be limited by this description or otherwise to exclude any variation or equivalent arrangement that would be apparent from or reasonably suggested by the foregoing disclosure to the skill of the art.

We claim:

1. In apparatus for wet processing textile material in endless strand form in which a vessel is provided for containing the treating liquor employed for the wet processing and through which liquor the textile material is circulated to and from a plaited accumulation thereof within said vessel, the improvement which comprises:

(a) a rotatable lifter roll disposed above said vessel and driven for vertically elevating said textile material progressively from said plaited accumulation and said treating liquor;

(b) a downwardly extending treating liquor tube;

(c) a downwardly inclined textile material directing tube disposed adjacent said lifter roll for receiving textile material therefrom, said directing tube having a downwardly extending cylindrical end portion concentrically enclosed within an intermediate cylindrical portion of said treating liquor tube, said intermediate portion being free of internal restriction and extending downwardly beyond said directing tube end portion;

(d) a discharge tube portion of said treating liquor tube free of internal restriction and extending from said intermediate tube portion downwardly for discharge into said vessel, the remaining portion of said directing tube being surrounded by an enlarged plenum chamber communicating with said intermediate portion of said treating liquor tube; and (e) means for continuously circulating treating liquor from said vessel to said plenum chamber for delivery to said treating liquor tube and return therethrough to said vessel while also effecting active treating liquor penetration of said textile material and facilitating the return of said material to said plaited accumulation.

2. In apparatus for wet processing textile material, the improvement defined in claim 1 wherein said textile material is piece goods and is circulated in rope form.

3. In apparatus for wet processing textile material, the improvement defined in claim 2 wherein said treating liquor is a dyestuff formulation.

4. In apparatus for wet processing textile material, the improvement defined in claim 1 wherein said lifter roll and downwardly inclined textile material directing tube are housed in a superstructure mounted on said vessel, said superstructure comprising a vertical intake leg through which said textile material is progressively elevated from the plaited accumulation in said vessel, a housing at the upper end of said intake leg enclosing said lifter roll and supporting the same for rotation, and a downwardly inclined discharge leg extending from said housing and having portions forming said plenum chamber and said treating liquor tube.

5. In apparatus for wet processing textile material, the improvement defined in claim 1 wherein said downwardly extending treating liquor tube is fitted with a diversion elbow ahead of the point of discharge of treating liquor and textile material through said tube into said vessel, and said diversion elbow is arranged to receive a major portion of the circulating treating liquor from said tube and is connected for separately directing the treating liquor portion received to said vessel below the treating liquor level therein and adjacent the point at which treating liquor is circulated from said vessel by the means provided therefor.

* * * * *